US011448047B2

(12) United States Patent
McChesney et al.

(10) Patent No.: US 11,448,047 B2
(45) Date of Patent: Sep. 20, 2022

(54) INTERNALLY ADJUSTABLE FLOW CONTROL MODULE

(71) Applicant: Halliburton Energy Services, Inc., Houston, TX (US)

(72) Inventors: Ryan Wesley McChesney, Prosper, TX (US); Gordon McLeary, Dallas, TX (US); David Symon Grant, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 5 days.

(21) Appl. No.: 16/933,347

(22) Filed: Jul. 20, 2020

(65) Prior Publication Data

US 2022/0018228 A1 Jan. 20, 2022

(51) Int. Cl.

| | |
|---|---|
| ***E21B 43/12*** | (2006.01) |
| ***E21B 23/00*** | (2006.01) |
| ***E21B 34/08*** | (2006.01) |

(52) U.S. Cl.

CPC ..... *E21B 43/12* (2013.01); *E21B 23/006* (2013.01); *E21B 34/08* (2013.01); *E21B 2200/06* (2020.05)

(58) Field of Classification Search

CPC .... E21B 43/12; E21B 23/006; E21B 2206/06; E21B 34/08; E21B 34/14

See application file for complete search history.

(56) References Cited

U.S. PATENT DOCUMENTS

| | | | | |
|---|---|---|---|---|
| 8,602,110 | B2 | 12/2013 | Kuo et al. | |
| 8,925,633 | B2 | 1/2015 | Nguyen | |
| 9,027,637 | B2 | 5/2015 | Kang et al. | |
| 9,725,985 | B2 | 8/2017 | McNamee et al. | |
| 10,041,338 | B2 | 8/2018 | Least | |
| 2004/0035578 | A1 | 2/2004 | Ross et al. | |
| 2005/0189106 | A1 | 9/2005 | Bode et al. | |
| 2013/0292133 | A1* | 11/2013 | Thompson | E21B 34/06 166/373 |
| 2014/0251627 | A1* | 9/2014 | Holderman | E21B 43/12 166/316 |
| 2016/0333666 | A1* | 11/2016 | McGlothen | E21B 23/006 |

FOREIGN PATENT DOCUMENTS

| | | | |
|---|---|---|---|
| CA | 2938715 | A1 | 2/2017 |
| EP | 2466058 | A1 | 6/2012 |
| WO | 2014025338 | A1 | 2/2014 |
| WO | 2015060728 | A1 | 4/2015 |
| WO | 2018190819 | A1 | 10/2018 |

* cited by examiner

*Primary Examiner* — George S Gray

(74) *Attorney, Agent, or Firm* — Scott Richardson; Parker Justiss, P.C.

(57) ABSTRACT

An adjustable flow control device. In one aspect, the flow control device comprises a base pipe having one or more openings extending from an exterior to an interior of the base pipe; and a movable sleeve positioned along the interior of the base pipe, the movable sleeve having one or more associated openings extending from an exterior to an interior of the movable sleeve, and configured to rotate to a first position that aligns a first of the base pipe openings with a first of the movable sleeve openings.

20 Claims, 5 Drawing Sheets

INTERNALLY ADJUSTABLE FLOW CONTROL MODULE

BACKGROUND

Wellbores may be drilled into subterranean formations to produce one or more fluids from the subterranean formation. In some environments, balancing the production of fluid along portions of the wellbore may provide a more controlled conformance, thereby increasing the proportion and overall quantity of desired fluid produced from the wellbore. Various devices and completion assemblies have been used to help balance the production of fluid from within the wellbore. For example, flow control devices, e.g., inflow control devices (ICDs) may be associated with a completion string of the wellbore to balance or control fluid inflow along the length of the wellbore.

BRIEF DESCRIPTION

Reference is now made to the following descriptions taken in conjunction with the accompanying drawings, in which.

DETAILED DESCRIPTION

Figure 1:
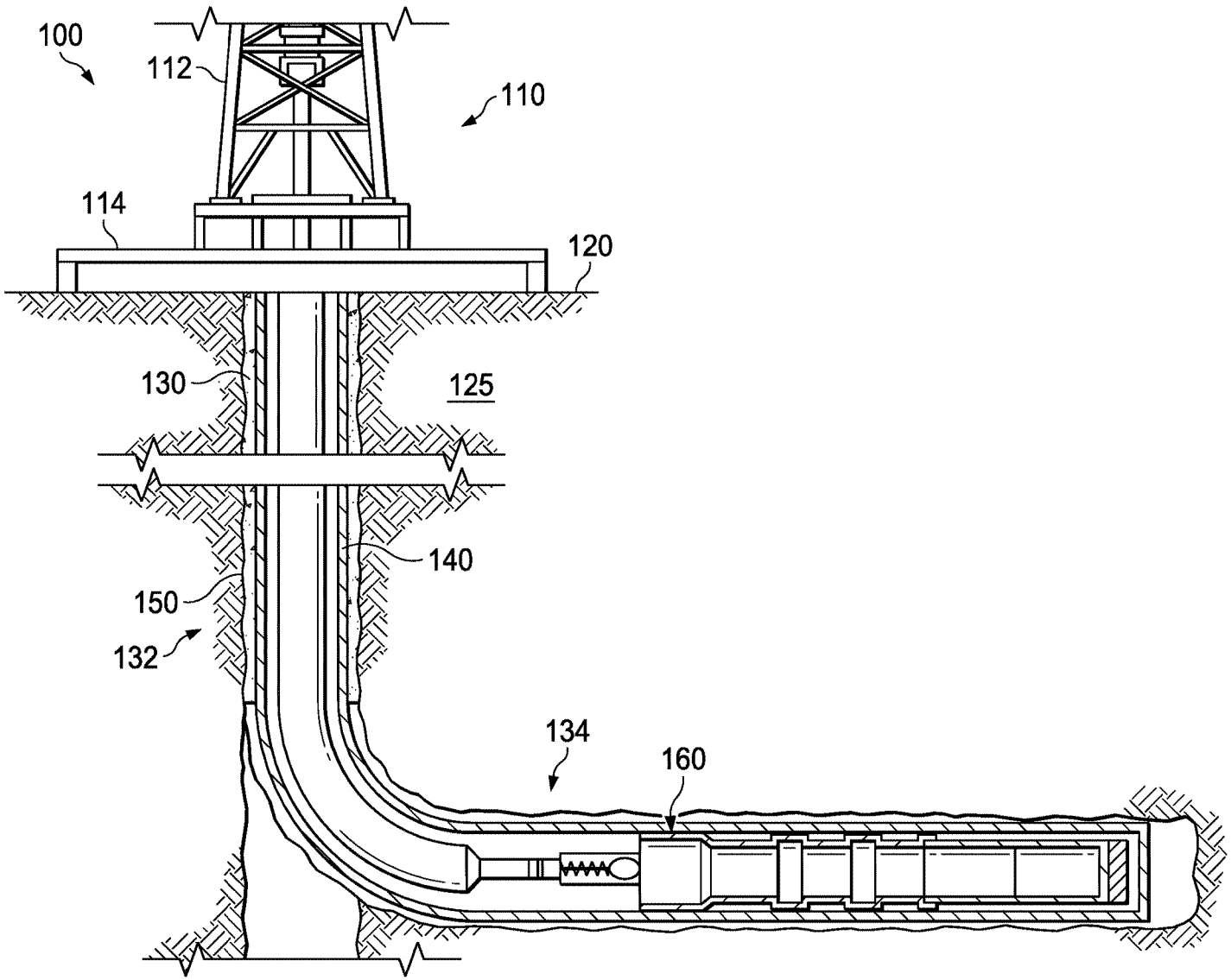
FIG. 1 illustrates a well system including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

FIG. 1 illustrates a well system 100 including an exemplary operating environment that the apparatuses, systems and methods disclosed herein may be employed. Unless otherwise stated, the horizontal, vertical, or deviated nature of any figure is not to be construed as limiting the wellbore to any particular configuration. As depicted, the well system 100 may suitably comprise a rig 110 positioned on the earth's surface 120, or alternatively moored to a sea floor in a body of water, and extending over and around a wellbore 130 penetrating a subterranean formation 125 for the purpose of recovering hydrocarbons and the like. The wellbore 130 may be drilled into the subterranean formation 125 using any suitable drilling technique. In one embodiment, the rig 110 comprises a derrick 112 with a rig floor 114. The rig 110 may be conventional and may comprise a motor driven winch and/or other associated equipment for extending a work string, a casing string, or both into the wellbore 130.

In one embodiment, the wellbore 130 may extend substantially vertically away from the earth's surface 120 over a vertical wellbore portion 132, or may deviate at any angle from the earth's surface 120 over a deviated wellbore portion 134. In this embodiment, the wellbore 130 may comprise one or more deviated wellbore portions 134. In alternative operating environments, portions or substantially all of the wellbore 130 may be vertical, deviated, horizontal, and/or curved. The wellbore 130, in this embodiment, includes a casing string 140. In the embodiment of FIG. 1, the casing string 140 is secured into position in the subterranean formation 125 in a conventional manner using cement 150.

Previous attempts to control wellbore fluid flow through sand control screens have included some methods such as utilizing threaded plugs, o-rings, or plugging rods to block or restrict the flow to inserts coupled with sand control screens; however, none of these methods have enabled in-field or internal adjustment. The well system 100 of the embodiment of FIG. 1 includes an adjustable flow control module 160 designed, manufactured and operated according to the disclosure. In accordance with one embodiment, the adjustable flow control module 160 may be placed radially inside a sand control screen, e.g., a hydraulic screen assembly. The adjustable flow control module 160 according to the disclosure may be internally adjustable in the field, such that the flow setting may be adjusted prior to running the flow control module 160 and sand control assembly into the wellbore 130.

The flow control module 160, in some embodiments, may include at least a base pipe having one or more base pipe openings extending from an exterior of the base pipe to an interior of the base pipe. A movable sleeve may be positioned along at least a portion of the interior of the base pipe, the movable sleeve having one or more associated movable sleeve openings. The one or more associated movable sleeve openings may extend from an exterior of the movable sleeve to an interior of the movable sleeve. In some embodiments, the movable sleeve may be configured to rotate to a first position that aligns a first of the one or more base pipe openings with a first of the one or more movable sleeve openings. In some embodiments, the movable sleeve may further rotate to a second position that aligns a second of the one or more base pipe openings with a second of the one or more movable sleeve openings and isolates or seals off the first of the one or more base pipe openings from the first of the one or more movable sleeve openings.

While the well system 100 depicted in FIG. 1 illustrates a stationary rig 110, one of ordinary skill in the art will readily appreciate that mobile workover rigs, wellbore servicing units (e.g., coiled tubing units), and the like may be similarly employed. Further, while the well system 100 depicted in FIG. 1 refers to a wellbore penetrating the earth's surface on dry land, it should be understood that one or more of the apparatuses, systems and methods illustrated herein may alternatively be employed in other operational environments, such as within an offshore wellbore operational environment for example, a wellbore penetrating subterranean formation beneath a body of water.

Figure 2A:
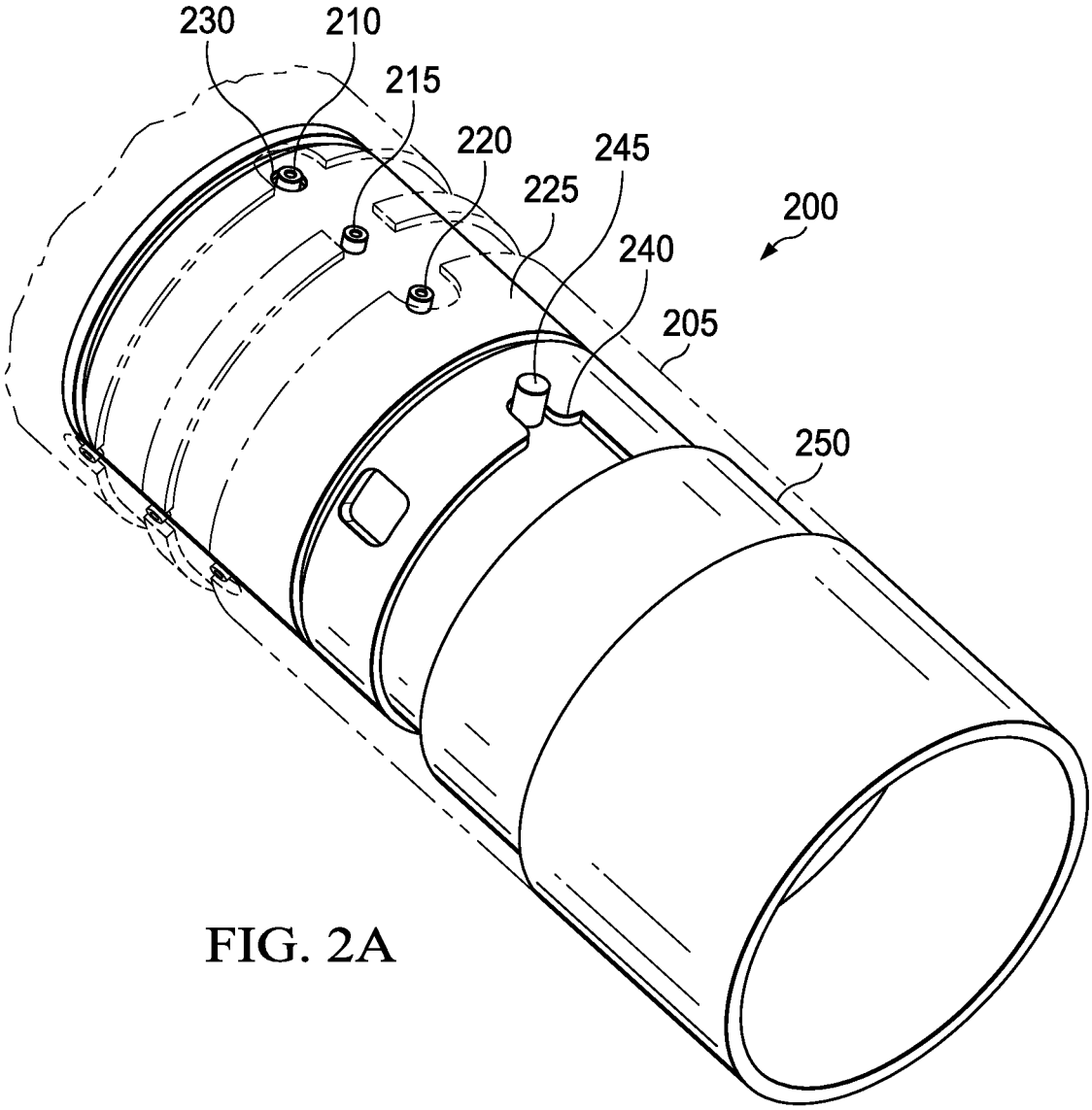
FIG. 2A illustrates one embodiment of an adjustable flow control module according to the disclosure which may be used with the well system of FIG. 1, shown in a first position.

FIG. 2A illustrates one embodiment of an adjustable flow control module 200 which may be used with the well system 100 of FIG. 1, shown in a first position. The adjustable flow control module 200, in some embodiments, may include at least a base pipe 205 having one or more base pipe openings 210, 215, and 220 extending from an exterior of the base pipe 205 to an interior of the base pipe 205. In some embodiments, there may only be one base pipe opening, but in certain embodiments, there may be two or more base pipe openings. The adjustable flow control module 200, in one example embodiment, is configured to control production fluid from an oil and gas formation to the interior of the base pipe 205 through at least one of the one or more base pipe openings 210, 215, and 220. In some embodiments, the flow control module 200 may be an inflow control devices (ICD) or an autonomous inflow control device (AICD).

A movable sleeve 225 may be positioned along at least a portion of the interior of the base pipe 205. The movable sleeve 225, in some embodiments, may have one or more movable sleeve openings extending from an exterior of the movable sleeve 225 to an interior of the movable sleeve 225. In some embodiments, there may only be one movable sleeve opening, but in certain embodiments, there may be two or more movable sleeve openings. A first movable sleeve opening 230 is visible in FIG. 2A. The movable sleeve 225 may be configured to rotate between at least the first position, as shown in FIG. 2A, and a second position. In the first position, the first base pipe opening 210 may be aligned with the first movable sleeve opening 230. The second base pipe openings 215 may be isolated or sealed off from a second movable sleeve opening 235 (shown in FIG. 2C). The movable sleeve 225 may, in certain embodiments, further rotate to at least a second position wherein the second base pipe opening 215 is aligned with the second movable sleeve opening 235 and the first base pipe opening 210 may be isolated or sealed off from with the first movable sleeve opening 230.

In some embodiments, the movable sleeve 225 may include two or more notches 240 for engaging with one or more associated indexing pins 245. The indexing pin 245 and notch 240, in one embodiment, may be configured to prevent the movable sleeve 225 from rotating when the indexing pin 245 is within the notch 240, but allow the movable sleeve 225 to rotate when the movable sleeve 225 is axially slid such that the indexing pin 245 is no longer within the notch 240. Accordingly, by axially sliding the movable sleeve 225 and then rotating the movable sleeve 225, a different opening in the base pipe may be chosen. In the first state, as shown in FIG. 2A, the indexing pin 245 is positioned in the first of the two or more notches 240, thus aligning the first movable sleeve opening 230 with the first base pipe opening 210.

The flow control module 200, in some embodiments, may be placed radially within a sand control screen assembly. The flow control module 200 may be adjustable internally, within the sand control screen assembly, prior to running the flow control module 200 in hole. In some embodiments, the movable sleeve 225 may be spring activated. The spring may hold the movable sleeve 225 in a locked position, e.g., the first position, to prevent the flow control module 200 from being accidentally rotated to a different position than adjusted prior to running in hole by external factors, e.g., intervention equipment or product vibration.

In some embodiments, the flow control module may be coupled with one or more adjacent flow control modules by a connecting mandrel 250, which in some embodiments may be a crossover mandrel. Although only one connecting mandrel 250 is shown in FIG. 2A, a second connecting mandrel may be positioned at an opposing end of the flow control module 200. For example, in some environments, the flow control module 200 may be placed within or between two sand control screens. In some embodiments, there may be one or more hydraulic activation chambers disposed exteriorly of the base pipe 205. The one or more hydraulic activation chambers may be fluidly connected with the sand control screen, and in some embodiments, fluidly connected with a filter medium of the sand control screen. The filter medium may be disposed about the one or more hydraulic activation chambers for receiving production fluid from an oil and gas formation. In some embodiments, the filter medium may be disposed over the one or more base pipe openings 210, 215, and 220.

Figure 2B:
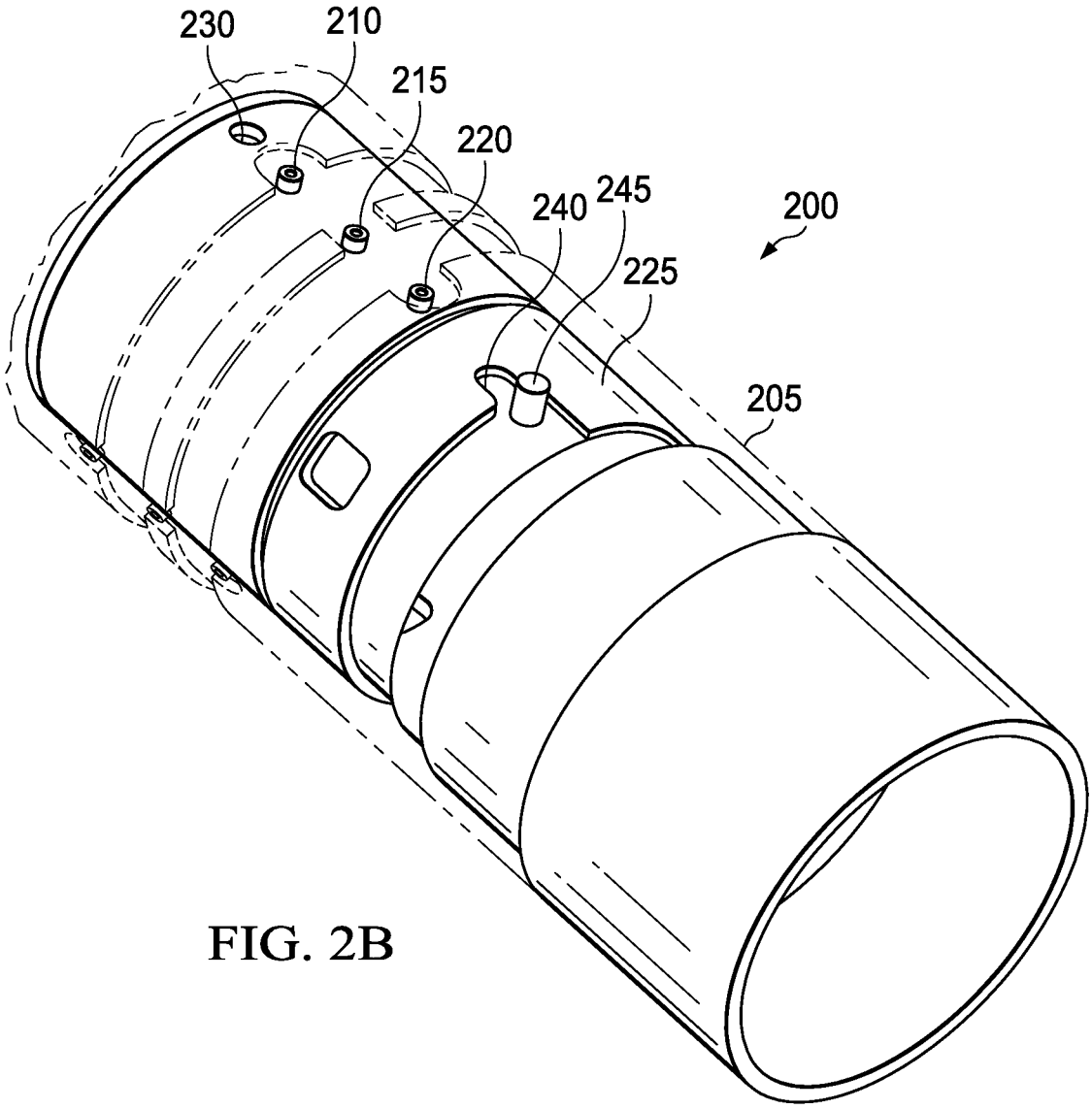
FIG. 2B illustrates the adjustable flow control module of FIG. 2A in an unlocked state.

FIG. 2B illustrates the adjustable flow control module 200 of FIG. 2A in an unlocked state. The movable sleeve 225, in this embodiment, may be configured to slide to disengage the indexing pin 245 from the first of the two or more notches 240. The first movable sleeve opening 230 may then misalign from the first base pipe opening 210 and the movable sleeve 225 may rotate toward at least a second position.

Figure 2C:
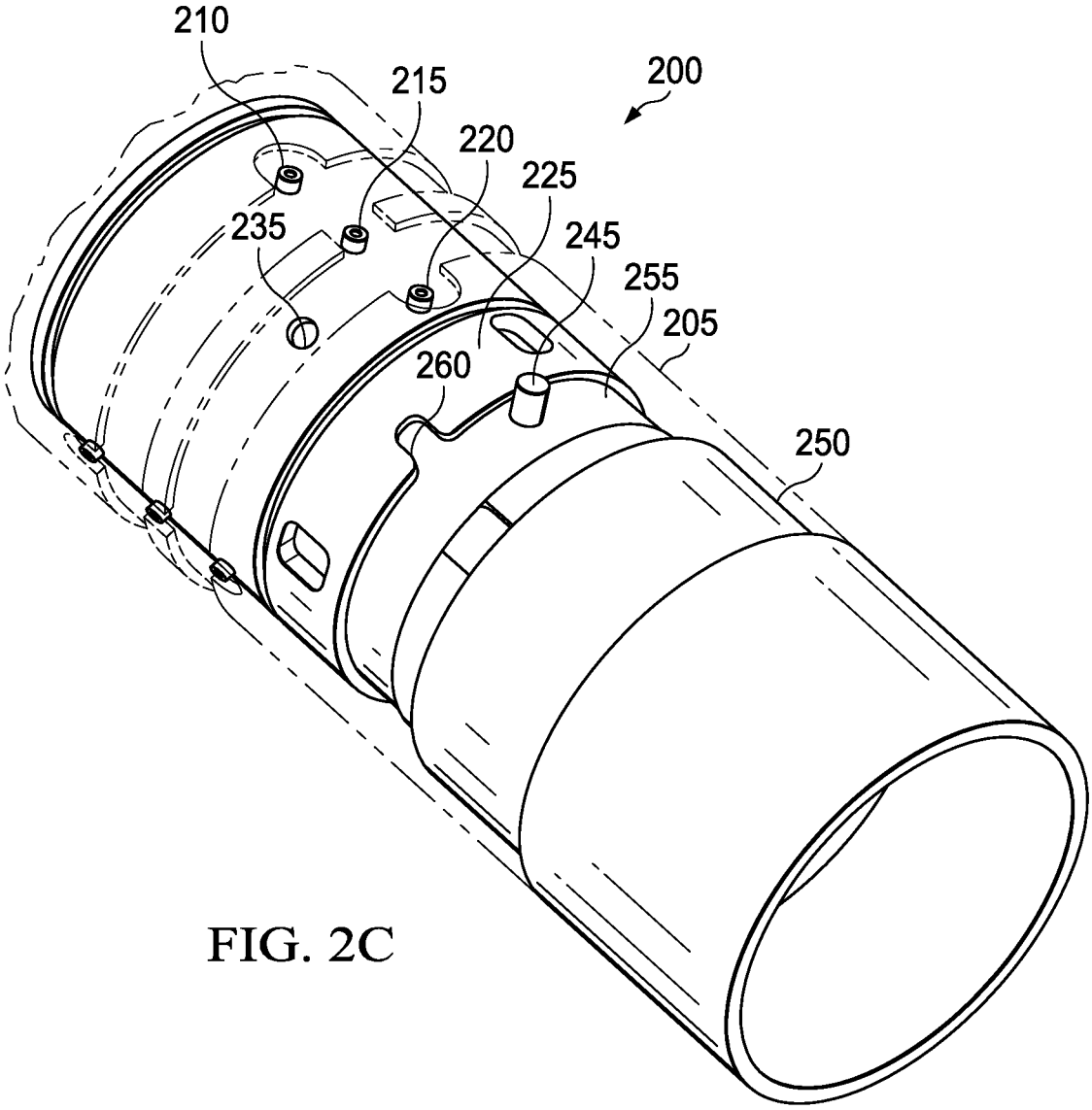
FIG. 2C illustrates the adjustable flow control module of FIG. 2A in a transitioning state.

FIG. 2C illustrates the adjustable flow control module 200 of FIG. 2A in a transitioning state. In this embodiment, the indexing pin 245 may slide along an edge 255 of the movable sleeve 225 in order to rotate the flow control module 200 into a second position. The second position (not shown), in this embodiment, may align the second movable sleeve opening 235 with the second base pipe opening 215 and the indexing pin 245 may be positioned in a second notch 260. In the example shown, there may be at least a third position, wherein a third movable sleeve opening 225 may align with the third base pipe opening 220. There may be other embodiments with more than three movable sleeve openings to accommodate more than 3 associated base pipe openings. There may also be positions wherein more than one movable sleeve openings are aligned with more than one associated base pipe opening, for a given movable sleeve position. Thus, in a situation wherein three base pipe openings are employed 210, 215, 220, it is envisioned that six different configurations are possible (e.g., 210, 215, 220, 210 +215, 210 +220, and 215 +220). If the three base pipe openings 210, 215, 220 were different size openings, six different flow rates could be achieved for this given design. In yet other embodiments (not shown), the movable sleeve might be positionable to open less than 100% of a given base pipe opening, thereby accommodating even greater possibilities. While the present disclosure have been illustrated and described with three base pipe openings 210, 215, 220, the concepts therein may be applied to configurations with two base pipe openings, or more than three base pipe openings without departing from the disclosure.

Figure 3:
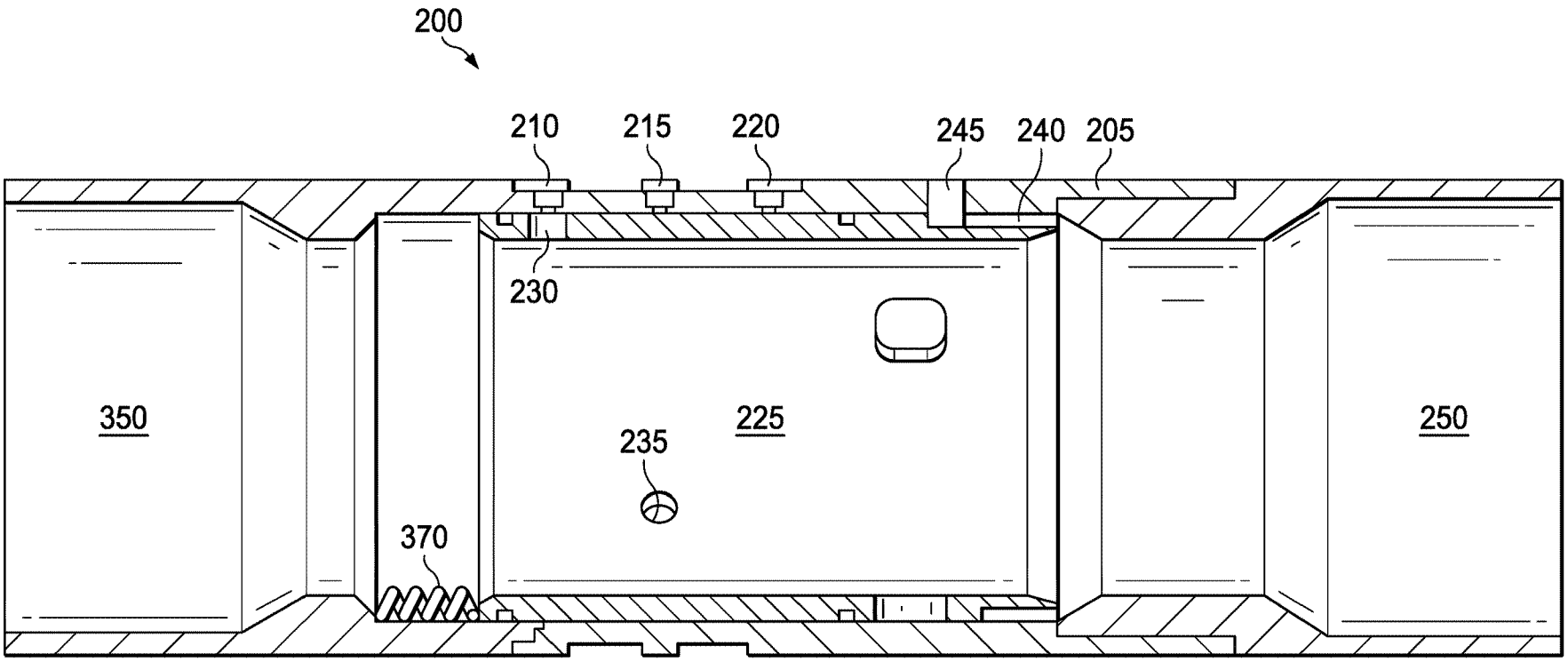
FIG. 3 illustrates a cross-section view of the adjustable flow control module of FIG. 2A.

FIG. 3 illustrates a cross-section view of the adjustable flow control module 200 of FIG. 2A. The cross-section view of FIG. 3 more readily illustrates the movable sleeve 225 in the first position, wherein the first base pipe opening 210 aligns with the first movable sleeve opening 230. The second movable sleeve opening 235 is shown mis-aligned with the second base pipe opening 215. The cross-section view of FIG. 3 also more readily illustrates a spring 370, which may hold the movable sleeve 225 in a desired locked position as the flow control module 200 is run in hole. Also shown in FIG. 3 is a second connecting mandrel 350 shown at an opposing end to the first connecting mandrel 250. Although the view of FIG. 3 illustrates spacing between the base pipe 205 and the movable sleeve 225, there may be embodiments where there is little or no spacing between the movable sleeve 225 and the base pipe 205.

Aspects disclosed herein include:

A: An adjustable flow control device, comprising: a base pipe having one or more base pipe openings extending from an exterior of the base pipe to an interior of the base pipe; and a movable sleeve positioned along at least a portion of the interior of the base pipe, the movable sleeve having one or more associated movable sleeve openings extending from an exterior of the movable sleeve to an interior of the movable sleeve, the movable sleeve configured to rotate to a first position that aligns a first of the one or more base pipe openings with a first of the one or more movable sleeve openings.

B: A method for modifying an adjustable flow control device, comprising: providing an adjustable flow control device, the adjustable flow control device including: a base pipe having one or more base pipe openings extending from an exterior of the base pipe to an interior of the base pipe; and a movable sleeve positioned along at least a portion of the interior of the base pipe, the movable sleeve having one or more associated movable sleeve openings extending from an exterior of the movable sleeve to an interior of the movable sleeve; and rotating the movable sleeve from a first position that aligns a first of the one or more base pipe openings with a first of the one or more movable sleeve openings to a second position isolating the first of the one or more base pipe openings from the first of the one or more movable sleeve openings.

C: A well system, comprising: a base pipe having one or more base pipe openings extending from an exterior of the base pipe to an interior of the base pipe; a screen subassembly, including: one or more hydraulic activation chambers disposed exteriorly of the base pipe; and a filter medium disposed about the one or more hydraulic activation chambers for receiving production fluid from an oil and gas formation; and a flow control module fluidly coupled beneath the screen subassembly, the flow control module including a movable sleeve positioned along at least a portion of the interior of the base pipe, the movable sleeve having one or more associated movable sleeve openings extending from an exterior of the movable sleeve to an interior of the movable sleeve, the movable sleeve configured to rotate to a first position that aligns a first of the one or more base pipe openings with a first of the one or more movable sleeve openings.

Aspects A, B, and C may have one or more of the following additional elements in combination:

Element 1: wherein the movable sleeve is further configured to rotate to a second position that aligns a second of the one or more base pipe openings with a second of the one or more movable sleeve openings and isolates the first of the one or more base pipe openings from the first of the one or more movable sleeve openings;

Element 2: wherein the movable sleeve includes two or more notches for engaging with an indexing pin;

Element 3: wherein the movable sleeve includes a channel between the two or more notches;

Element 4: wherein the movable sleeve is configured to: slide to disengage a first of the two or more notches from the indexing pin and then to rotate from the first position; and slide to disengage a second of the two or more notches from the indexing pin and then to rotate to the second position;

Element 5: further including one or more hydraulic activation chambers disposed exteriorly of the base pipe, and a filter medium disposed about the one or more hydraulic activation chambers for receiving production fluid from an oil and gas formation;

Element 6: wherein the filter medium is disposed over the one or more base pipe openings;

Element 7: wherein the movable sleeve is spring activated;

Element 8: further comprising a connecting mandrel positioned at both ends of the movable sleeve;

Element 9: wherein the base pipe has two or more base pipe openings and the movable sleeve has two or more movable sleeve openings, and further wherein a second of the two or more base pipe openings and a second of the two or more movable sleeve openings are aligned when the movable sleeve is in the second position;

Element 10: wherein rotating the movable sleeve from a first position to a second position includes activating a spring to release the movable sleeve from a locked position;

Element 11: wherein rotating the movable sleeve from a first position to a second position includes sliding an indexing pin out from a first notch to misalign the first of the one or more base pipe openings with the first of the one or more movable sleeve openings;

Element 12: further including sliding the indexing pin along a channel connecting the first notch and a second notch, and sliding the indexing pin into the second notch to secure the rotating movable sleeve in the second position;

Element 13: wherein the movable sleeve includes two or more notches for engaging with an indexing pin, and a channel between the two or more notches;

Further additions, deletions, substitutions and modifications may be made to the described embodiments.

What is claimed is:

1. An adjustable flow control device, comprising:

a base pipe having two or more base pipe openings extending from an exterior of the base pipe to an interior of the base pipe, wherein the two or more base pipe openings are axially offset from one another; and a movable sleeve positioned along at least a portion of the interior of the base pipe, the movable sleeve having two or more associated movable sleeve openings extending from an exterior of the movable sleeve to an interior of the movable sleeve, the two or more associated movable sleeve openings axially offset from one another and radially offset from one another, the movable sleeve configured to rotate to a first position that aligns a first of the two or more base pipe openings with a first of the two or more movable sleeve openings and rotate to a second position that aligns a second of the two or more base pipe openings with a second of the two or more movable sleeve openings.

2. The adjustable flow control device as recited in claim 1, wherein the second position isolates the first of the two or more base pipe openings from the first of the two or more movable sleeve openings.

3. The adjustable flow control device as recited in claim 2, wherein the movable sleeve includes two or more notches and an indexing pin, the indexing pin configured to engage with a first of the two or more notches when holding the movable sleeve in the first position and engage with a second of the two or more notches to hold the movable sleeve in the second position.

4. The adjustable flow control device as recited in claim 3, wherein the movable sleeve includes a channel between the two or more notches.

5. The adjustable flow control device as recited in claim 4, wherein the movable sleeve is configured to:

slide to disengage a first of the two or more notches from the indexing pin and then to rotate from the first position; and slide to disengage a second of the two or more notches from the indexing pin and then to rotate to the second position.

6. The adjustable flow control device as recited in claim 1, further including a filter medium disposed about the base pipe for receiving production fluid from an oil and gas formation.

7. The adjustable flow control device as recited in claim 6, wherein the filter medium in disposed over the two or more base pipe openings.

8. The adjustable flow control device as recited in claim 1, wherein the movable sleeve is spring activated, such that the spring may hold the movable sleeve in a locked position.

9. The adjustable flow control device as recited in claim 1, further comprising a connecting mandrel positioned at one end of the base pipe.

10. A method for modifying an adjustable flow control device, comprising:

providing an adjustable flow control device, the adjustable flow control device including:

a base pipe having two or more base pipe openings extending from an exterior of the base pipe to an interior of the base pipe, wherein the two or more base pipe openings are axially offset from one another; and a movable sleeve positioned along at least a portion of the interior of the base pipe, the movable sleeve having two or more associated movable sleeve openings extending from an exterior of the movable sleeve to an interior of the movable sleeve, the two or more associated movable sleeve openings axially offset from one another and radially offset from one another; and rotating the movable sleeve from a first position that aligns a first of the two or more base pipe openings with a first of the two or more movable sleeve openings to a second position that aligns a second of the two or more base pipe openings with a second of the two or more movable sleeve openings.

11. The method for modifying an adjustable flow control device as recited in claim 10, wherein rotating the movable sleeve to the second position isolates the first of the two or more base pipe openings from the first of the two or more movable sleeve openings.

12. The method for modifying an adjustable flow control device as recited in claim 11, wherein rotating the movable sleeve from a first position to a second position includes compressing a spring to release the movable sleeve from a locked position.

13. The method for modifying an adjustable flow control device as recited in claim 10, wherein rotating the movable sleeve from a first position to a second position includes sliding an indexing pin out from a first notch to misalign the first of the two or more base pipe openings with the first of the two or more movable sleeve openings.

14. The method for modifying an adjustable flow control device as recited in claim 13, further including sliding the indexing pin along a channel connecting the first notch and a second notch, and sliding the indexing pin into the second notch to secure the rotating movable sleeve in the second position.

15. A well system, comprising:

a base pipe having two or more base pipe openings extending from an exterior of the base pipe to an interior of the base pipe, wherein the two or more base pipe openings are axially offset from one another;

a screen subassembly, including a filter medium disposed about the base pipe for receiving production fluid from an oil and gas formation; and a flow control module fluidly coupled beneath the screen subassembly, the flow control module including a movable sleeve positioned along at least a portion of the interior of the base pipe, the movable sleeve having two or more associated movable sleeve openings extending from an exterior of the movable sleeve to an interior of the movable sleeve, the two or more associated movable sleeve openings axially offset from one another and radially offset from one another, the movable sleeve configured to rotate to a first position that aligns a first of the two or more base pipe openings with a first of the two or more movable sleeve openings and rotate to a second position that aligns a second of the two or more base pipe openings with a second of the two or more movable sleeve openings.

16. The well system as recited in claim 15, wherein the second position isolates the first of the two or more base pipe openings from the first of the two or more movable sleeve openings.

17. The well system as recited in claim 15, wherein the movable sleeve includes two or more notches for engaging with an indexing pin, and a channel between the two or more notches.

18. The well system as recited in claim 17, wherein the movable sleeve is configured to:

slide to disengage a first of the two or more notches from the indexing pin and then to rotate from the first position; and slide to disengage a second of the two or more notches from the indexing pin and then to rotate to the second position.

19. The well system recited in claim 15, wherein the filter medium is disposed over the two or more base pipe openings.

20. The well system as recited in claim 15, wherein the movable sleeve further includes a connecting mandrel positioned at both ends of the movable sleeve.

* * * * *